US006353166B1

(12) United States Patent
Signor

(10) Patent No.: US 6,353,166 B1
(45) **Date of Patent: *Mar. 5, 2002**

(54) DRUMSTICK

(76) Inventor: Gary Signor, 538 E. 27th Ave., Apt. 2H, North Kansas City, MO (US) 64116

( * ) Notice: Subject to any disclaimer, the term of this patent is extended or adjusted under 35 U.S.C. 154(b) by 0 days.

This patent is subject to a terminal disclaimer.

(21) Appl. No.: 09/659,161

(22) Filed: Sep. 11, 2000

Related U.S. Application Data

(63) Continuation of application No. 09/296,442, filed on Apr. 21, 1999, now Pat. No. 6,118,061.

(51) Int. Cl.[7] ..... G10D 13/02
(52) U.S. Cl. ..... 84/422.4
(58) Field of Search ..... 84/422.4

(56) References Cited

U.S. PATENT DOCUMENTS 4,246,826 A * 1/1981 Warrick et al. ..... 84/422.4
4,320,688 A * 3/1982 Donohoe ..... 84/422.4
4,590,839 A * 3/1986 Liedtke et al. ..... 84/422.4
5,044,250 A * 9/1991 Beyer ..... 84/422.4
5,170,001 A * 12/1992 Amendola ..... 84/422.4
5,179,237 A * 1/1993 Grossman ..... 84/422.4
5,341,716 A * 8/1994 Donohoe ..... 84/422.4

OTHER PUBLICATIONS

Specialty Sticks Photograph.*

New Brushes Photograph.*

* cited by examiner

*Primary Examiner*—Shih-Yung Hsieh
(74) *Attorney, Agent, or Firm*—Brinks Hofer Gilson & Lione

(57) ABSTRACT

An improved drumstick is provided. The drumstick comprises a handle, a mid-section and a striking section. The striking section has a width in a horizontal plane that exceeds that of the mid-section.

3 Claims, 2 Drawing Sheets

DRUMSTICK

This application is a continuation of application Ser. No. 09/296,442, filed Apr. 21,1999, is now U.S. Pat. No. 6,118,061.

FIELD OF THE INVENTION

This invention is directed to the field of drumsticks, and, more particularly, to an improved drumstick having a striking section with an increased surface area for striking a drumhead.

BACKGROUND OF THE INVENTION

As those skilled in the art will readily appreciate, the classic or traditional drumstick has an elongated, tubular shape with a substantially consistent surface area and cross-sectional thickness extending along the entire length of the drumstick. The traditional drumstick normally is made of wood and has a plastic piece at the striking end of the stick, i.e., the end of the stick that strikes that drumhead. The traditional drumstick provides a "hard" sound when it strikes a drumhead or cymbal. Moreover, the wood that comprises a substantial portion of the body of the stick tends to suffer rimshot damage that results from portions of the stick striking the metal rim that normally surrounds that drumhead.

Several variations on the traditional drumstick were developed to make the stick more durable and to provide a "softer" sound. One such variation is a stick with a durable, metal body that employs a series of wire brushes for striking the drumhead to provide a "softer" sound. It is also known to construct drumsticks from polymeric materials instead of wood to make the sticks more durable. Examples of the foregoing types of drumsticks are disclosed in U.S. Pat. Nos. 5,341,716; 5,044,250; 5,179,237; and 4,246,826 and are commercially available under the trademarks HOT RODS, BLASSTICKS and WOODWACKS. These commercially available sticks are used mostly for a "softer" sound in acoustic, jazz, country, or soft rock situations . A problem, however, with these commercially available "soft" sounding drumsticks is that they are relatively more complicated to manufacture than the traditional stick. These softer sounding drumsticks are typically constructed from a multitude of parts. An additional problem with these sticks is that they provide too "soft" a sound for some musical situations.

Before the present invention, the options typically available to a drummer where the traditional drumstick that provided a "hard" sound and the foregoing variations that provided a "softer" sound, but which were constructed from numerous parts and thus were more complicated to manufacture than the one piece traditional stick. There was thus a need in the art for a durable drumstick that provides a "soft" sound and had the ease of construction of the traditional drumstick. There was also a need for a drumstick that could provide a sound that was "softer" than the traditional drumstick but "harder" than the soft sounding drumsticks previously known.

SUMMARY OF THE INVENTION

The present invention addresses the foregoing needs. In one aspect, the invention is directed to a drumstick with an increased surface area for striking a drumhead. The drumstick comprises a handle, a striking section for striking the drumhead, and a mid-section connecting the handle and the striking section of the drumstick. The handle may be of any shape that is suitable for the user (the drummer) for gripping and holding the drumstick. The mid-section of the drumstick has a certain width in a horizontal plane and a certain vertical cross-sectional thickness. The striking section comprises a continuous planar surface having a width in a horizontal plane that exceeds that of the mid-section and having a vertical cross-sectional thickness that is less than that of the mid-section.

In another aspect of the invention, the striking section of the drumstick comprises a series of rivets positioned on a leading end of the planar surface of the striking section.

In yet another aspect of the invention, the striking section of the drumstick comprises a series of wire inserts on the planar surface extending from a leading end of the striking section towards the mid-section of the drumstick.

In another aspect of the invention, the drumstick is constructed from a single piece, durable polymeric material, which is formed by injection molding.

DETAILED DESCRIPTION OF PREFERRED EMBODIMENT

Figure 1:
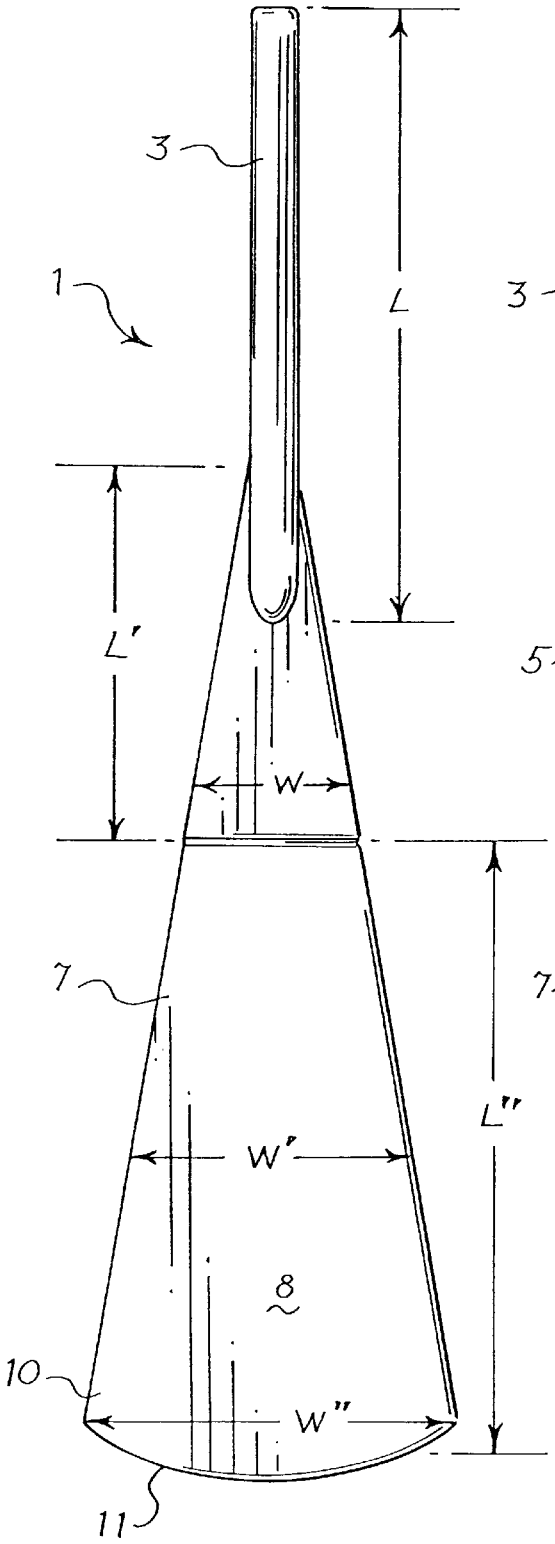
FIG. 1 is a top view of the drumstick according to one aspect of the invention.
Figure 2:
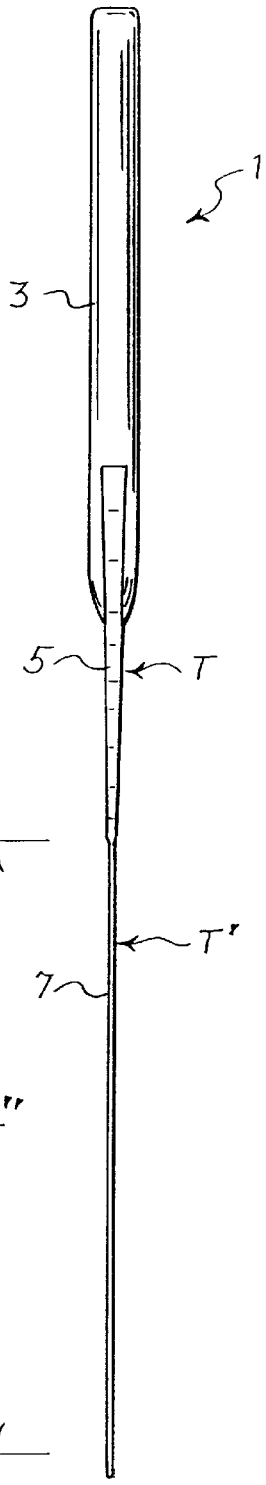
FIG. 2 is a side view of the drumstick illustrated in FIG. 1.

With reference to FIG. 1, in one aspect of the invention the drumstick 1 comprises a handle 3, a mid-section 5 and a striking section 7. The handle 3 may be of any suitable shape for gripping and holding the drumstick and, preferably, has a tubular shape. Most preferably, the handle has a diameter of about ½" to ⅝". The length L of the handle is most preferably about 5".

The mid-section 5 has a width W and a thickness T. Preferably, the width W of the mid-section increases in a direction extending from the handle 3 towards the striking section 7. Conversely, the thickness T of the mid-section preferably, decreases in a direction extending from the handle 3 towards the striking end 7. Most preferably, the width W of the mid-section 5 increases from about ⅝" at the handle to about 2 and ½" where the mid-section meets the striking section 7. The thickness T of the mid-section most preferably decreases from about ¼" at the handle end to about 1/16" where the mid-section 5 meets the striking section 7. The length L' of the mid-section 5 is most preferably about 3–4".

The striking section 7 comprises a continuous planar surface 8 having a width W' and a thickness T'. The planar surface 8 preferably has a width W' that is greater than the width W of mid-section 5. Most preferably, the width W' of the planar surface 8 increases in a direction extending from the mid-section 5 to the leading end 10 of the striking section 7. Even more preferably, the leading end 10 is curved as shown at reference numeral 11 in FIG. 1. The width W' of the striking section 7 preferably increases from about 2 and ½" where it meets the mid-section to about 4–5" at line W" just prior to the curved leading end 11. The striking section 7 preferably has a uniform thickness, which is most preferably about 0.075". The length L" of the striking section is preferably about 7". Thus, the total length of the drumstick 1 is about 15–16".

Most preferably, the drumstick 1 is constructed by injection molding a polymeric material. As those skilled in the art will appreciate, the drumstick 1 may, therefore, be of one-piece construction. Preferred materials from which to construct the drumstick include polyplastics, or NYLON.

Figure 4:
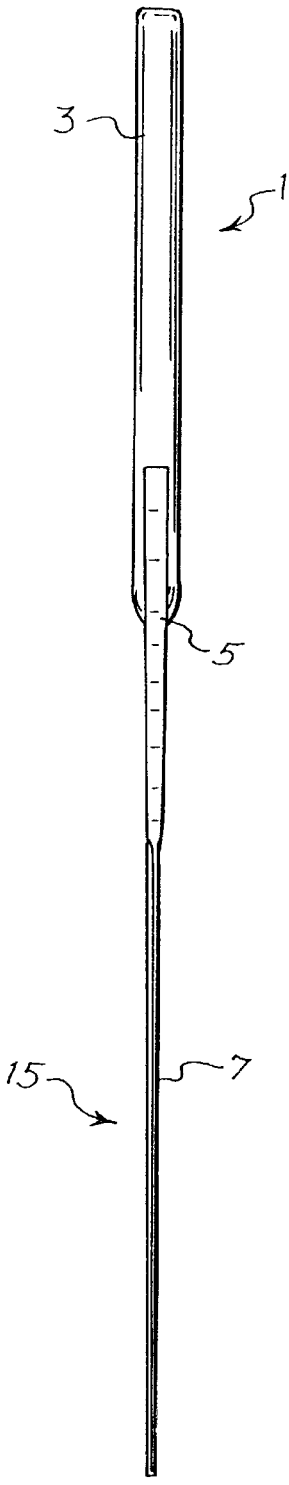
FIG. 4 is a side view of the drumstick illustrated in FIG. 3.
Figure 3:
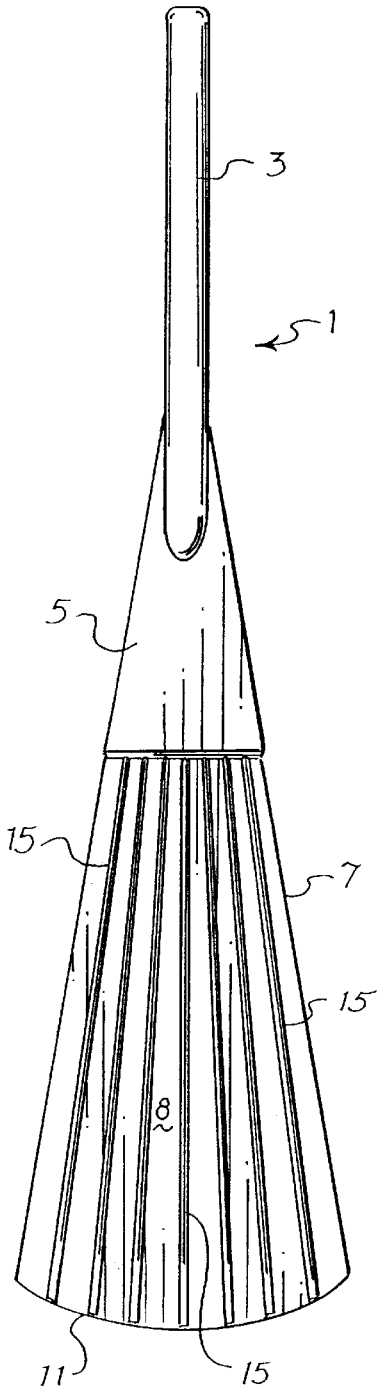
FIG. 3 is a top view of a drumstick with wire inserts according to another aspect of the invention.

With reference to FIGS. 3 and 4, in another aspect of the invention wire inserts 15 are positioned on the planar surface 8 of the striking section 7. Preferably, the wire inserts 15 extend along from the mid-section 5 to the leading curved end 11 of the striking section 7. The wire inserts 15 are preferably constructed from steel.

Figure 5:
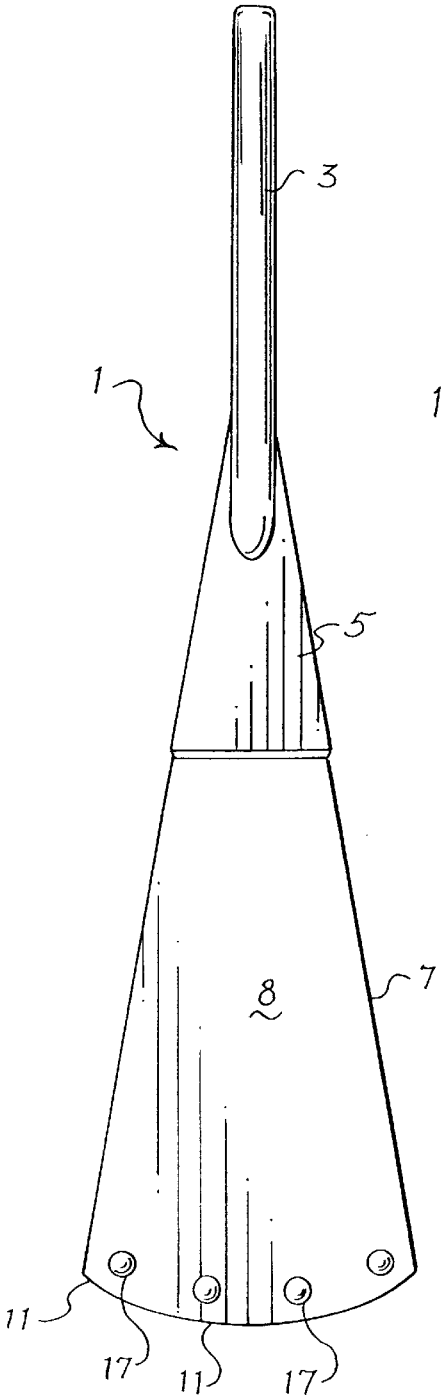
FIG. 5 is a top view of a drumstick with rivets according to yet another aspect of the present invention.
Figure 6:
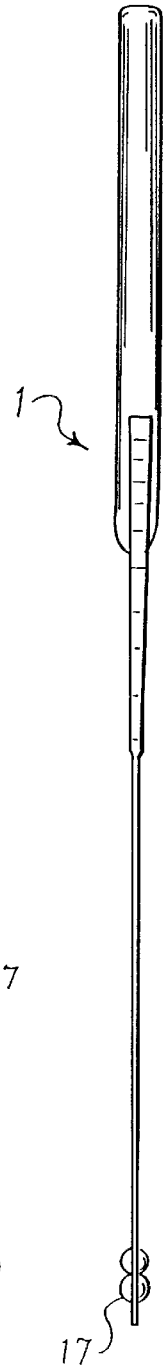
FIG. 6 is a side view of the drumstick illustrated in FIG. 5.

With reference to FIGS. 5 and 6, in yet another aspect of the invention rivets 17 may be provided at the leading curved end 11 of the drumstick 1. The rivets are preferably constructed from brass or copper.

I claim:

1. A drumstick for striking a drumhead, the drumstick comprising:

(a) a handle, a mid-section and a striking section;

(b) the mid-section connecting the handle and striking section, the mid-section and striking section each comprising a continuous planar surface having a width in a horizontal plane;

(c) wherein the width of the striking section planar surface exceeds the width of mid-section planar surface.

2. The drumstick of claim 1 wherein the striking section comprises a series of rivets positioned adjacent a leading end of the striking section.

3. The drumstick of claim 1 wherein the striking section comprises a series of wire inserts extending from a leading end of the striking section to the midsection of the drumstick.

* * * * *